US008755717B2

(12) United States Patent
Tanaka et al.

(10) Patent No.: US 8,755,717 B2
(45) Date of Patent: Jun. 17, 2014

(54) CHARGING DEVICE AND IMAGE FORMING APPARATUS

(75) Inventors: Arichika Tanaka, Kanagawa (JP); Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 88 days.

(21) Appl. No.: 13/448,006

(22) Filed: Apr. 16, 2012

(65) Prior Publication Data

US 2013/0121729 A1 May 16, 2013

(30) Foreign Application Priority Data

Nov. 14, 2011 (JP) ..... 2011-249056

(51) Int. Cl.
*G03G 15/02* (2006.01)

(52) U.S. Cl.
USPC ..... 399/171

(58) Field of Classification Search
USPC ..... 399/171
See application file for complete search history.

(56) References Cited

U.S. PATENT DOCUMENTS

| | | | | |
|---|---|---|---|---|
| 5,079,668 | A * | 1/1992 | Maeshima | 361/229 |
| 2008/0226334 | A1 * | 9/2008 | Ohno et al. | 399/100 |
| 2008/0253805 | A1 * | 10/2008 | Yoshino | 399/171 |
| 2010/0061765 | A1 * | 3/2010 | Fowler et al. | 399/173 |

FOREIGN PATENT DOCUMENTS

JP 2008-262114 A 10/2008

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

A charging device includes a discharge electrode that is attached to a base member and discharges electricity to supply an electric charge to a latent-image carrier that carries an electrostatic latent image, a control electrode that is located on the latent-image-carrier side of the discharge electrode attached to the base member, that is curved along the latent-image carrier, and that controls a potential of the latent-image carrier, a support member that is fixed to the base member by a fixing member and includes a curved support surface that supports both ends of the control electrode in a longitudinal direction at a side at which the discharge electrode is provided, and first and second pressing members that are provided at respective ends of the control electrode in the longitudinal direction and that press the control electrode against the support surface.

4 Claims, 11 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-249056 filed Nov. 14, 2011.

BACKGROUND (i) Technical Field

The present invention relates to a charging device and an image forming apparatus.

(ii) Related Art

In an image forming apparatus that forms a latent image on an image carrier and forms a toner image by supplying toner to the latent image, a charging device is used to charge an outer peripheral surface of the image carrier.

Such a charging device includes a charge wire (an example of a discharge electrode) that supplies an electric charge to the image carrier and a grid electrode (an example of a control electrode) that controls the potential of the image carrier. The grid electrode may be curved along the image carrier to increase the charging speed of the image carrier.

SUMMARY

According to an aspect of the invention, there is provided a charging device including a discharge electrode that is attached to a base member and discharges electricity to supply an electric charge to a latent-image carrier that carries an electrostatic latent image, a control electrode that is located on the latent-image-carrier side of the discharge electrode attached to the base member, that is curved along the latent-image carrier, and that controls a potential of the latent-image carrier, a support member that is fixed to the base member by a fixing member and includes a curved support surface that supports both ends of the control electrode in a longitudinal direction at a side at which the discharge electrode is provided, and first and second pressing members that are provided at respective ends of the control electrode in the longitudinal direction and that press the control electrode against the support surface.

BRIEF DESCRIPTION OF THE DRAWINGS

An exemplary embodiment of the present invention will be described in detail based on the following figures, wherein.

DETAILED DESCRIPTION

Figure 1:
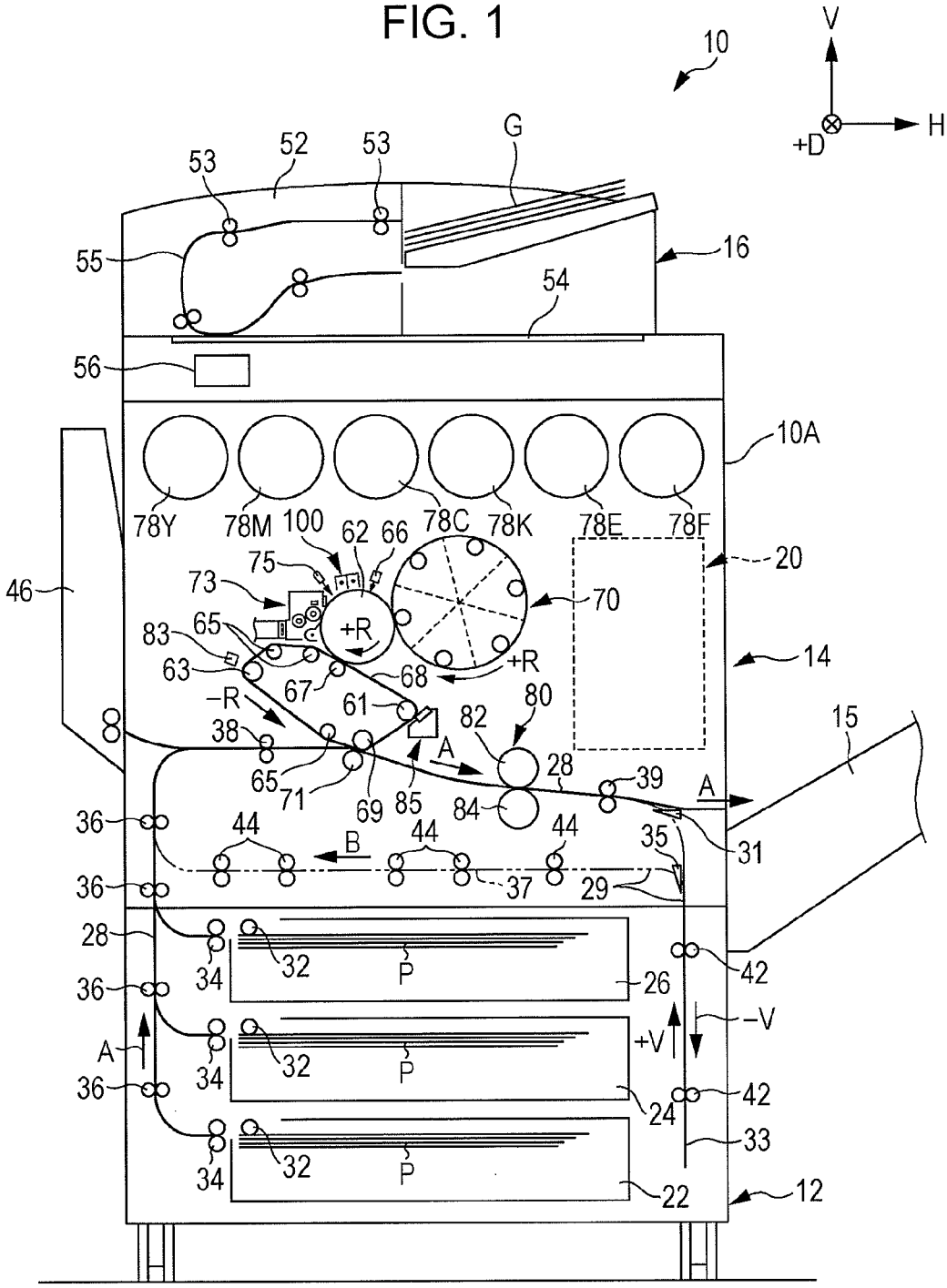
FIG. 1 illustrates the overall structure of an image forming apparatus according to an exemplary embodiment of the present invention.

An exemplary embodiment of the present invention will now be described in detail with reference to the drawings. In the drawings illustrating the exemplary embodiment, identical components are denoted by the same reference numerals, and explanations thereof are thus omitted.

FIG. 1 illustrates an image forming apparatus 10 according to the exemplary embodiment of the present invention.

The image forming apparatus 10 includes, in order from bottom to top in the vertical direction (direction of arrow V), a sheet storing unit 12 in which recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction, the left-right (horizontal) direction, and the depth (horizontal) direction with respect to an apparatus body 10A of the image forming apparatus 10 will be referred to as the direction of arrow V, the direction of arrow H, and the direction of arrow +D, respectively.

The sheet storing unit 12 includes a first storage unit 22, a second storage unit 24, and a third storage unit 26 in which sheets of recording paper P, which are examples of recording media, having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 linearly extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow −V (downward in FIG. 1) from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H (leftward in FIG. 1). The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29 so as to change the transporting direction of each sheet of recording paper P. Similarly, the second switching member 35 has the shape of a triangular prism, and a point end of the second switching member 35 is moved by a driving unit (not shown) to one of the reversing unit 33 and the transporting unit 37 so as to change the transporting direction of each sheet of recording paper P. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The manual sheet-feeding unit 46 is connected to the transport path 28 at a position in front of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transport rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical photoconductor 62, which is an example of a latent-image carrier, disposed in a central area of the apparatus body 10A. The photoconductor 62 is rotated in the direction of arrow +R (clockwise in FIG. 1) by a driving unit (not shown), and carries an electrostatic latent image formed by irradiation with light. In addition, a scorotron charging unit 100, which is an example of a charging device that charges the surface of the photoconductor 62, is provided above the photoconductor 62 so as to face the outer peripheral surface of the photoconductor 62. The charging unit 100 will be described in detail below.

Figure 2:
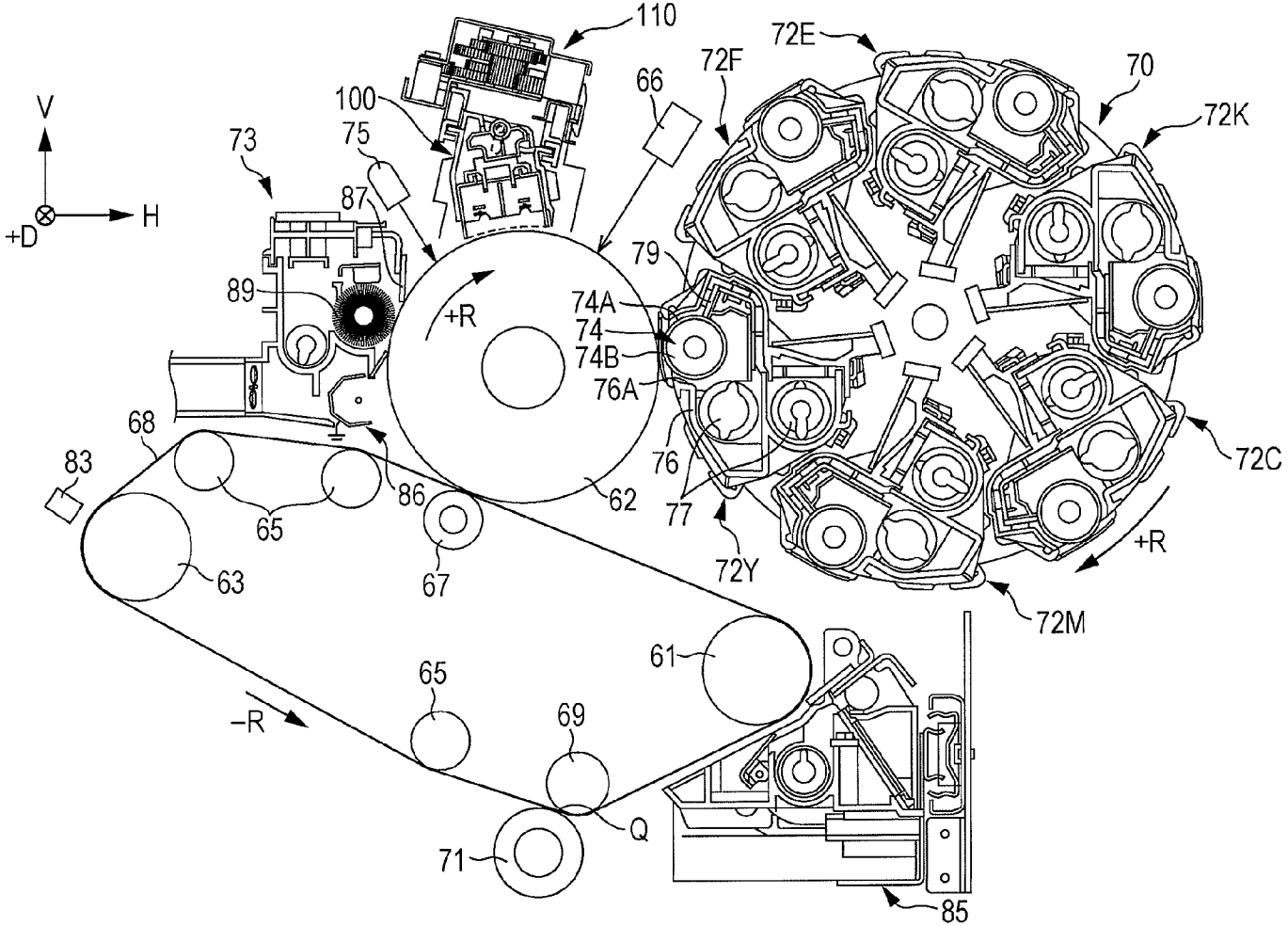
FIG. 2 illustrates the structure of an image forming unit according to the exemplary embodiment of the present invention.

As illustrated in FIG. 2, an exposure device 66 is provided so as to face the outer peripheral surface of the photoconductor 62 at a position downstream of the charging unit 100 in the rotational direction of the photoconductor 62. The exposure device 66 includes a light emitting diode (LED). The outer peripheral surface of the photoconductor 62 that has been charged by the charging unit 100 is irradiated with light (exposed to light) by the exposure device 66 on the basis of an image signal corresponding to each color of toner. Thus, an electrostatic latent image is formed. The exposure device 66 is not limited to those including LEDs. For example, the exposure device 66 may be structured such that the outer peripheral surface of the photoconductor 62 is scanned with a laser beam by using a polygon mirror.

A rotation-switching developing device 70, which is an example of a developing member, is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction of arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71, which is an example of a transfer member, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position (position Q in FIG. 2) at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 85 is opposed to the driving roller 61 with the intermediate transfer belt 68 interposed therebetween. The cleaning device 85 collects residual toner that remains on the intermediate transfer belt 68 after the second transfer process. A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade 87 and a brush roller 89 (see FIG. 2) that are in contact with the surface of the photoconductor 62.

An erase device 86 (see FIG. 2) is provided upstream of the cleaning device 73 and downstream of the first transfer roller 67 in the rotational direction of the photoconductor 62. The erase device 86 removes the electric charge by irradiating the outer peripheral surface of the photoconductor 62 with light. The erase device 86 removes the electric charge by irradiating the outer peripheral surface of the photoconductor 62 with light before the residual toner and the like are collected by the cleaning device 73. Accordingly, the electrostatic adhesive force is reduced and the collection rate of the residual toner and the like is increased. An erase lamp 75 for removing the electric charge after the collection of the residual toner and the like may be provided downstream of the cleaning device 73 and upstream of the charging unit 100.

The second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction of arrow A). The fixing device 80 fixes the toner images that have been transferred onto the sheet of recording paper P by the second transfer roller 71.

The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the direction of arrow H in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected.

When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An image forming process performed by the image forming apparatus 10 will now be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

Next, electricity is applied to charge wires 102A and 102B (see FIG. 3), which are examples of a discharge electrode, in the charging unit 100, so that a potential difference is generated between the photoconductor 62, which is grounded, and the charge wires 102A and 102B. Accordingly, corona discharge occurs and the outer peripheral surface of the photoconductor 62 is charged. At this time, a bias voltage is applied to the grid electrode 104 (see FIG. 3), which is an example of a control electrode, so that the charge potential (discharge current) of the photoconductor 62 is within an allowable range.

The exposure device 66 emits light in accordance with the image data, and the outer peripheral surface of the photoconductor 62, which has been charged by the charging unit 100, is exposed to the emitted light. Accordingly, an electrostatic latent image corresponding to the yellow image data is formed on the surface of the photoconductor 62. The electrostatic latent image formed on the surface of the photoconductor 62 is developed as a yellow toner image by the developing unit 72Y. The yellow toner image on the surface of the photoconductor 62 is transferred onto the intermediate transfer belt 68 by the first transfer roller 67.

Then, referring to FIG. 2, the developing device 70 is rotated by 60° in the direction of arrow +R, so that the developing unit 72M is opposed to the surface of the photoconductor 62. Then, the charging process, the exposure process, and the developing process are performed so that a magenta toner image is formed on the surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

A sheet of recording paper P is fed from the sheet storing unit 12 and transported along the transport path 28, as illustrated in FIG. 1. Then, the sheet is transported by the positioning rollers 38 to the second transfer position (position Q in FIG. 2) in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction of arrow A (rightward in FIG. 1). The fixing device 80 fixes the toner images to the sheet of recording paper P by applying heat and pressure thereto with the heating roller 82 and the pressing roller 84. The sheet of recording paper P to which the toner images are fixed is ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction of arrow −V. Then, the sheet of recording paper P is transported in the direction of arrow +V, so that the leading and trailing edges of the sheet of recording paper P are reversed. Then, the sheet of recording paper P is transported along the duplex-printing transport path 29 in the direction of arrow B (leftward in FIG. 1), and is inserted into the transport path 28. Then, the back surface of the sheet of recording paper P is subjected to the image forming process and the fixing process.

Next, the charging unit 100 and an attachment structure for the charging unit 100 will be described.

Figure 3:
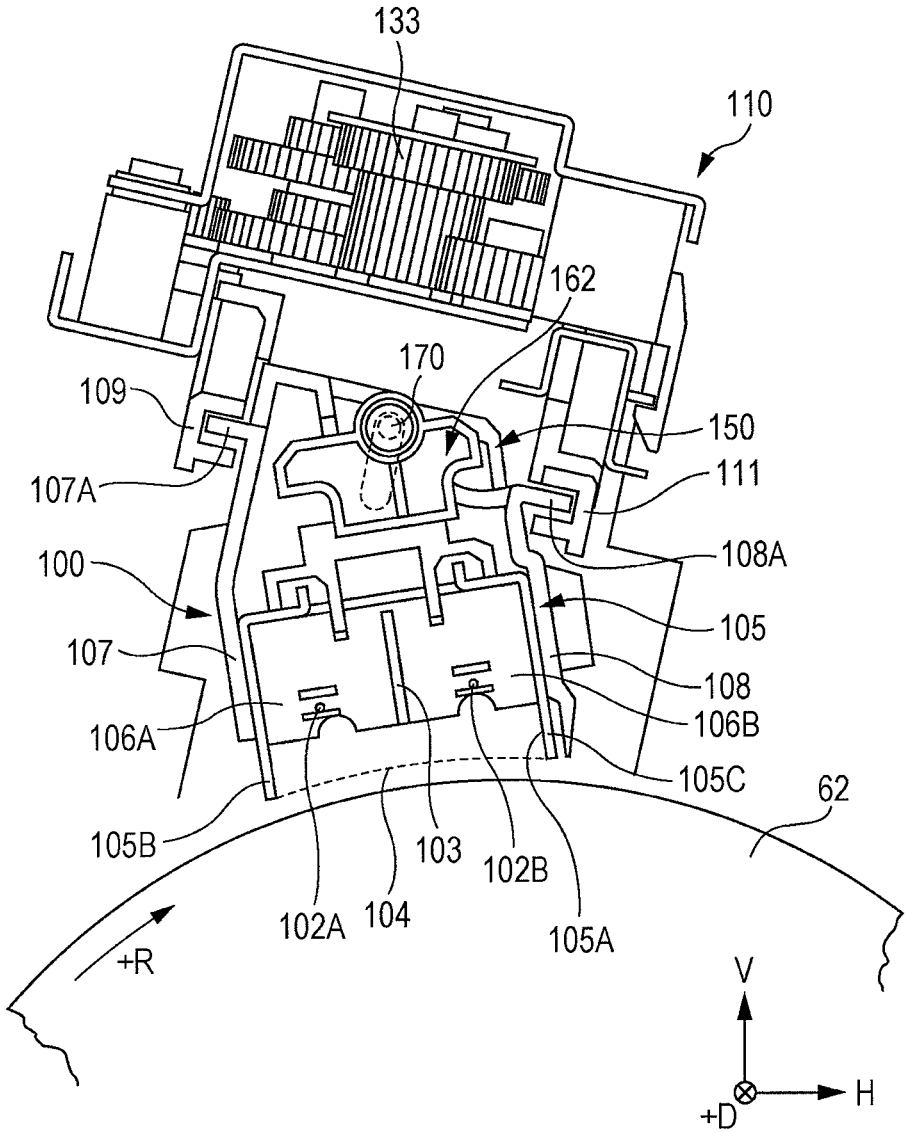
FIG. 3 illustrates the structure of an area around a photoconductor according to the exemplary embodiment of the present invention.

As illustrated in FIG. 3, the charging unit 100 includes a shielding member 105 (an example of a base member) that is angular U-shaped in the H-V plane (cross section). The inner space of the shielding member 105 is divided into chambers 106A and 106B by a partition plate 103 that stands so as to extend in the direction of arrow +D. The chamber 106A is at the upstream side in the direction of arrow +R, and the chamber 106B is at the downstream side in the direction of arrow +R. The shielding member 105 has, for example, an opening 105A that faces the outer peripheral surface of the photoconductor 62.

The charge wire 102A, which is an example of a discharge electrode, is disposed in the chamber 106A so as to extend in the direction of arrow +D. Similarly, the charge wire 102B, which is also an example of a discharge electrode, is disposed in the chamber 106B so as to extend in the direction of arrow +D. The grid electrode 104, which is an example of a control electrode, is attached to the shielding member 105 so as to cover the opening 105A. The grid electrode 104 is disposed between the outer peripheral surface of the photoconductor 62 and the charge wires 102A and 102B in the H-V plane. The grid electrode 104 and a grid cleaner 150, which cleans the grid electrode 104, will be described in detail below.

Cover members 107 and 108 that stand in the direction of arrow V are attached to outer surfaces of a pair of side walls 105B and 105C of the shielding member 105 that face each other in the direction of arrow H. The cover member 107 is bent outward (leftward in FIG. 3) into the shape of the letter 'L' at the top end thereof, and thus a plate-shaped guide member 107A is formed. The cover member 108 is bent outward (rightward in FIG. 3) into the shape of the letter 'L' at the top end thereof, and thus a plate-shaped guide member 108A is formed. The guide members 107A and 108A are guided in the direction of arrow +D and retained (restrained from being moved) in the directions shown by arrows H and V by guide rails 109 and 111, which will be described below. Accordingly, the charging unit 100 is disposed so as to face the outer peripheral surface of the photoconductor 62.

Figure 4:
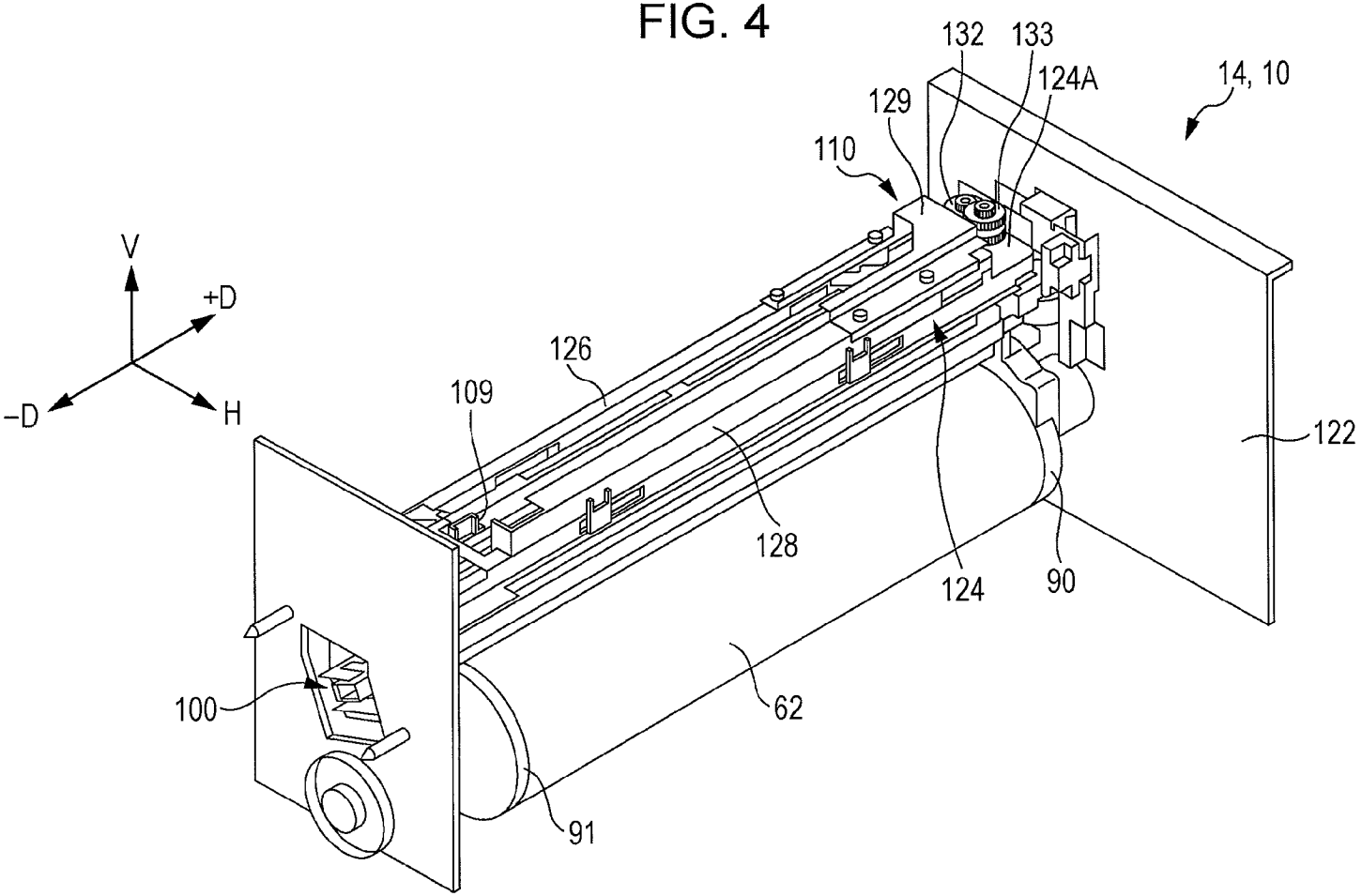
FIG. 4 is a perspective view illustrating the arrangement of the photoconductor and the charging unit according to the exemplary embodiment of the present invention.

Referring to FIG. 4, housings 90 and 91 that support the photoconductor 62 in a rotatable manner are provided at both ends of the photoconductor 62 in the axial direction. The photoconductor 62 and the housings 90 and 91 form a latent-image forming device.

As illustrated in FIG. 4, an attachment portion 110 to which the charging unit 100 is attached is provided above the photoconductor 62 in the direction of arrow V. The attachment portion 110 includes a base plate 124; slide members 126 and 128 which have a rectangular parallelepiped shape and are movable along the base plate 124 in the direction of arrow +D (or in the direction of arrow −D); a motor 132 which serves as a drive source for moving the slide members 126 and 128; and the guide rails 109 and 111 (see FIG. 3) which vertically move along the direction of arrow V in response to the movements of the slide members 126 and 128.

A flat portion 124A is provided at an end of the base plate 124. The motor 132 and a gear train 133, which transmits the driving force of the motor 132 to the slide member 128 as described below, are placed on the flat portion 124A.

When the attachment portion 110 is viewed in the direction of arrow +D, the slide member 126 is retained on the top surface of the base plate 124 at the left end thereof such that the slide member 126 is slidable in the direction of arrow +D, and the slide member 128 is retained on the top surface of the base plate 124 at the right end thereof such that the slide member 128 is slidable in the direction of arrow +D. A connecting member 129 is fixed with screws to the top surfaces of the slide members 126 and 128. Since the connecting member 129 is fixed to the top surfaces of the slide members 126 and 128, the slide members 126 and 128 move together in the direction of arrow +D or the direction of arrow −D.

Figure 5A:
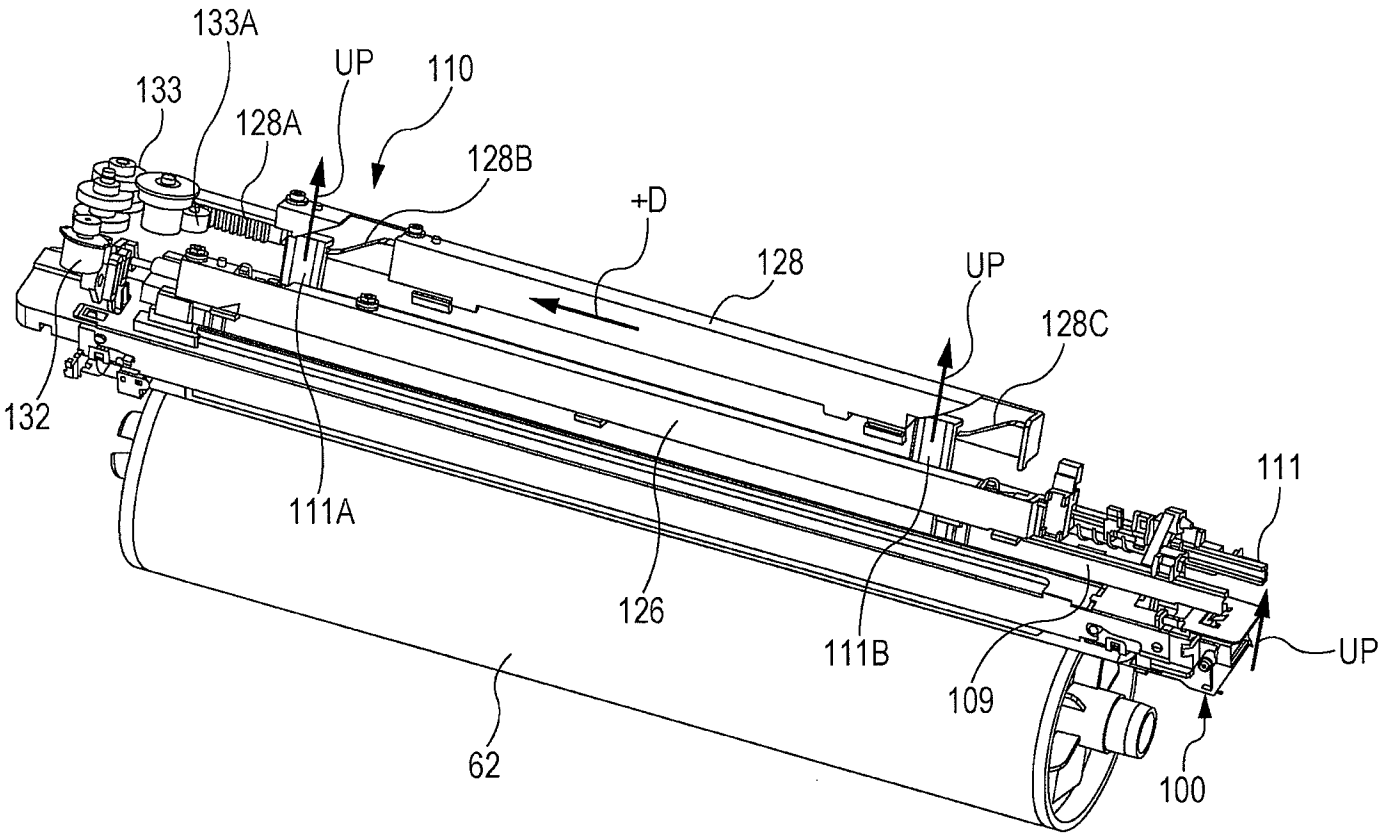
FIG. 5A illustrates the state in which the charging unit is near the photoconductor according to the exemplary embodiment of the present invention.
Figure 5B:
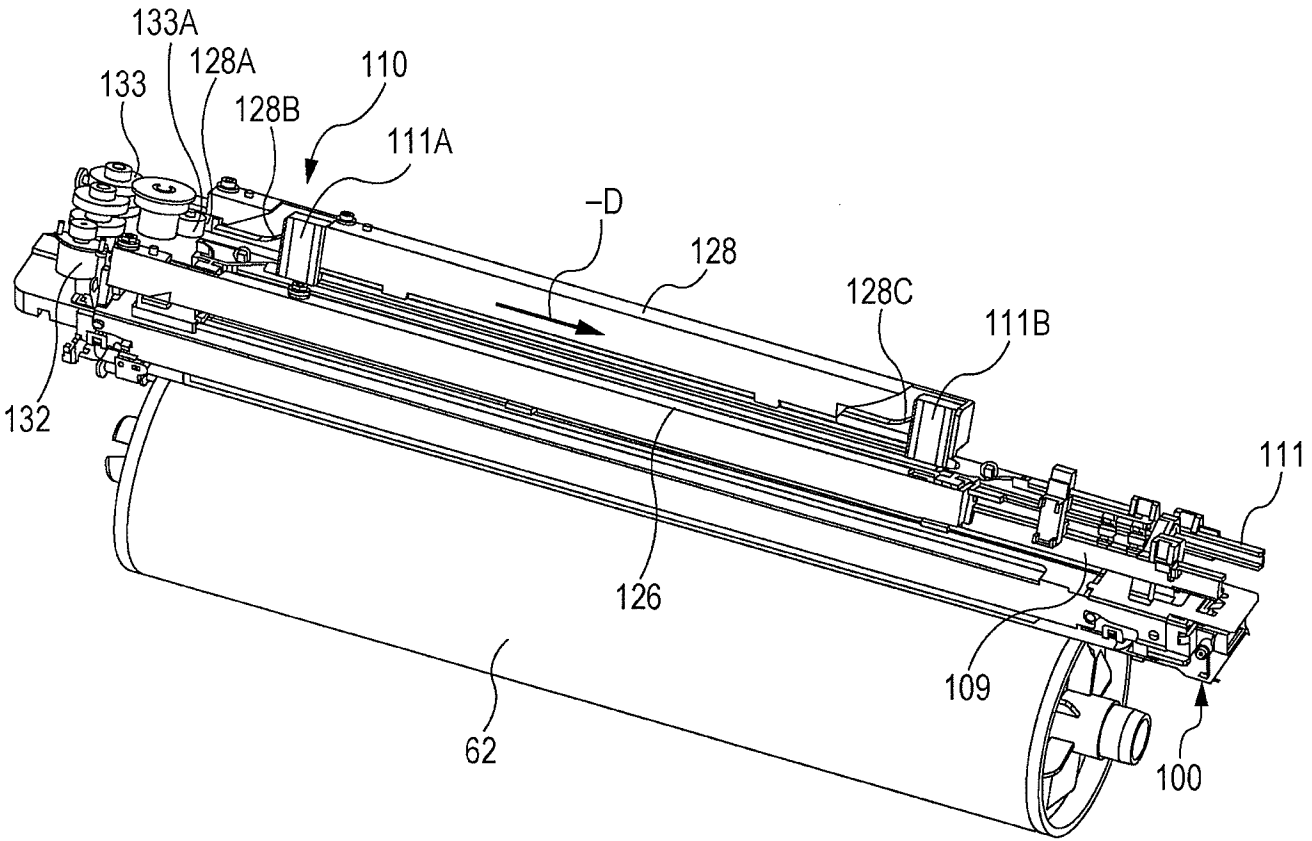
FIG. 5B illustrates the state in which the charging unit is separated from the photoconductor according to the exemplary embodiment of the present invention.

Referring to FIGS. 5A and 5B, the slide member 128 is provided with a rack portion 128A disposed near the gear train 133 and cam portions 128B and 128C arranged in the direction of arrow +D with an interval therebetween. The rack portion 128A meshes with a pinion 133A, which is one of gears included in the gear train 133. The rack portion 128A is linearly moved in the direction of arrow +D or the direction of arrow −D in response to a rotation of the pinion 133A. Each of the cam portions 128B and 128C includes an inclined portion which is inclined obliquely downward with respect to the direction of arrow +D and upper and lower flat portions which continuously extend from the top end and the bottom end, respectively, of the inclined portion.

The guide rail 111, which guides the charging unit 100 in the direction of arrow +D and retains the charging unit 100 above the photoconductor 62, is provided at the bottom of the slide member 128. Hook portions 111A and 111B are provided on the guide rail 111 with an interval therebetween in the direction of arrow +D. The hook portions 111A and 111B have the shape of an inverted letter 'L' when viewed in the direction of arrow +D, and flat portions at the top thereof are engaged with the cam portions 128B and 128C of the slide member 128. The hook portions 111A and 111B are positioned at the bottom ends of the cam portions 128B and 128C when the image forming process is performed.

In the above-described structure, when the slide member 128 is moved in the direction of arrow +D in response to the rotation of the pinion 133A, the hook portions 111A and 111B move upward (in the direction of arrows UP) along the inclined surfaces of the cam portions 128B and 128C. Accordingly, the guide rail 111 move in the direction of arrows UP.

Similar to the slide member 128, the slide member 126 is also provided with cam portions (not shown) which are inclined obliquely downward with respect to the direction of arrow +D, and hook portions (not shown) provided on the guide rail 109 are engaged with the cam portions. Although the slide member 126 has no rack, since the slide member 126 is integrated with the slide member 128 by the connecting member 129 (see FIG. 4), the slide member 126 moves in the direction of arrow +D when the slide member 128 moves in the direction of arrow +D. Accordingly, the hook portions move upward along the cam portions, and the guide rail 109 move upward in the direction of arrows UP.

As described above, when the slide members 126 and 128 move in the direction of arrow +D, the guide rails 109 and 111 move in the direction of arrows UP. Accordingly, the charging unit 100, which is retained by the guide rails 109 and 111, is moved away from the outer peripheral surface of the photoconductor 62 in the direction of arrows UP.

Referring to FIG. 5A, when the image forming process is performed, the slide members 126 and 128 are moved in the direction of arrow −D with respect to the base plate 124 (see FIG. 4) so that the charging unit 100 is retained at a position where the charging unit 100 may charge the outer peripheral surface of the photoconductor 62. When the charging unit 100 is attached to or detached from the image forming unit 14 (see FIG. 1), the slide members 126 and 128 are moved in the direction of arrow +D with respect to the base plate 124 (see FIG. 4), so that the guide rails 109 and 111 are moved upward. Accordingly, as illustrated in FIG. 5B, the charging unit 100 is retained at a position where the charging unit 100 is further away from the photoconductor 62 than the position at which the charging unit 100 charges the outer peripheral surface of the photoconductor 62. The base plate 124 (see FIG. 4) is not illustrated in FIGS. 5A and 5B.

The charging unit 100 includes attachment members 142 and 144 (see FIGS. 8 to 10) which are used to attach the grid electrode 104 to the charging unit 100. The attachment members 142 and 144 are integrated with the shielding member 105 at both ends thereof.

Figure 7A:
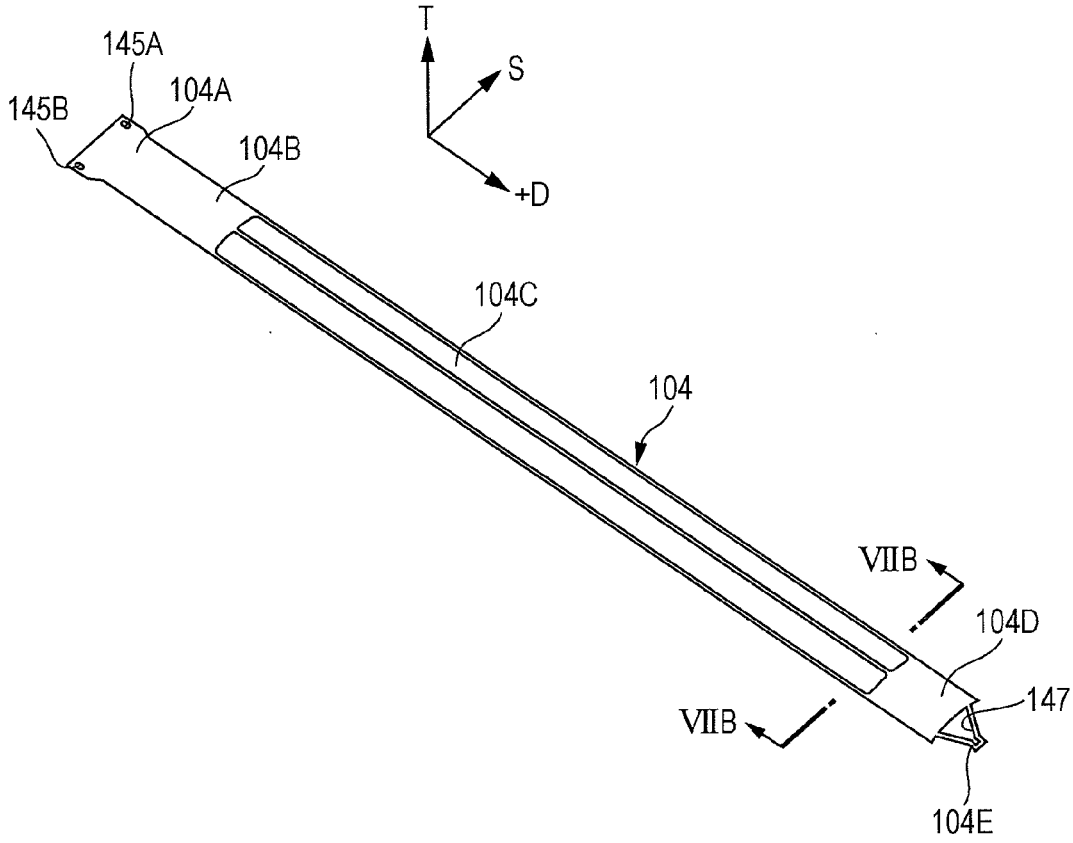
FIG. 7A is a perspective view illustrating the overall structure of the grid electrode according to the exemplary embodiment of the present invention.

The grid electrode 104 has a rectangular shape in plan view, and includes, in order from one end to the other in the longitudinal direction, an attachment portion 104A, a non-electrode portion 104B, an electrode portion 104C, a non-electrode portion 104D, and an attachment portion 104E, which are integrated with each other (see FIG. 7A).

Figure 7B:
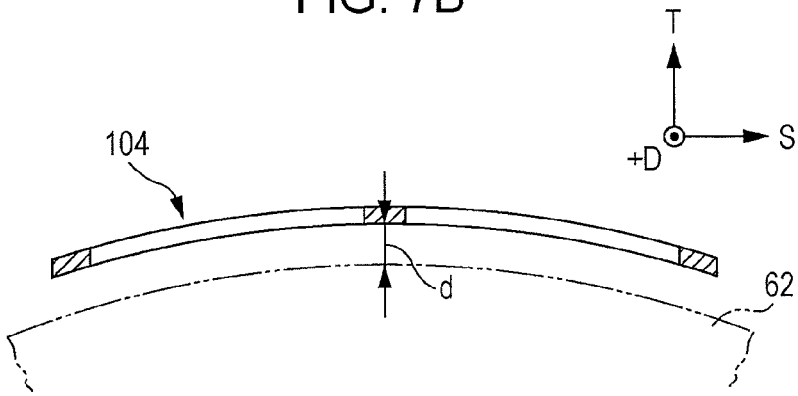
FIG. 7B is a sectional view of the grid electrode according to the exemplary embodiment of the present invention taken along a short-side direction.

The grid electrode 104 is curved in the S-T plane, which will be described below (see FIG. 7B). More specifically, the attachment portion 104A, the non-electrode portion 104B, the electrode portion 104C, the non-electrode portion 104D, and the attachment portion 104E of the grid electrode 104 are convexly curved toward the charge wires 102A and 102B (see FIG. 3). Referring to FIG. 7B, the curvature of the attachment portion 104A, the non-electrode portion 104B, the electrode portion 104C, the non-electrode portion 104D, and the attachment portion 104E is set such that a distance d to the outer peripheral surface of the photoconductor 62 is constant along the circumferential direction of the photoconductor 62. In other words, the above-mentioned portions are curved along the outer peripheral surface of the photoconductor 62.

Figure 6:
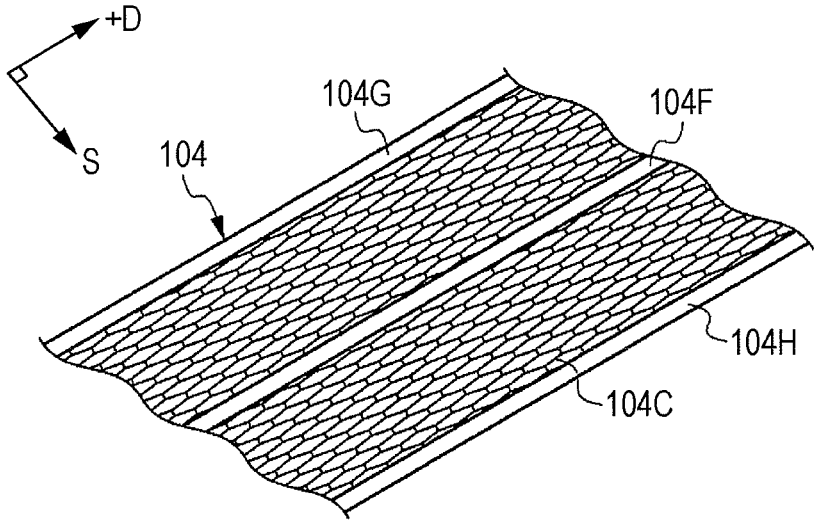
FIG. 6 illustrates the shape of an electrode portion of a grid electrode according to the exemplary embodiment of the present invention.

Referring to FIG. 6, the electrode portion 104C of the grid electrode 104 has a mesh pattern including plural hexagonal holes. A frame portion 104F and frame portions 104G and 104H for increasing the rigidity are respectively formed at the center and sides of the electrode portion 104C in the direction of arrow S, that is, in the short-side direction orthogonal to the direction of arrow +D. Outermost parts of the frame portions 104G and 104H in the direction of arrow S are flush with the attachment portions 104A and 104E. The electrode portion 104C is sectioned into two areas, which are an area surrounded by the frame portion 104G, the non-electrode portion 104B, the frame portion 104F, and the non-electrode portion 104D and an area surrounded by the frame portion 104F, the non-electrode portion 104B, the frame portion 104H, and the non-electrode portion 104D. The hexagonal holes in the electrode portion 104C are illustrated only in FIG. 6, and are not illustrated in other figures.

As illustrated in FIG. 7A, the attachment portion 104A of the grid electrode 104 has attachment holes 145A and 145B, which are through holes that extend in the direction of arrow T (thickness direction), which is orthogonal to the direction of arrow +D and the direction of arrow S. The attachment holes 145A and 145B have a rectangular shape and are formed with an interval therebetween in the direction of arrow S at a first end of the grid electrode 104. The attachment portion 104E has an attachment hole 147, which is a through hole that extends in the direction of arrow T. The attachment portion 104E has a substantially triangular shape and is formed at a second end of the grid electrode 104.

Figure 8:
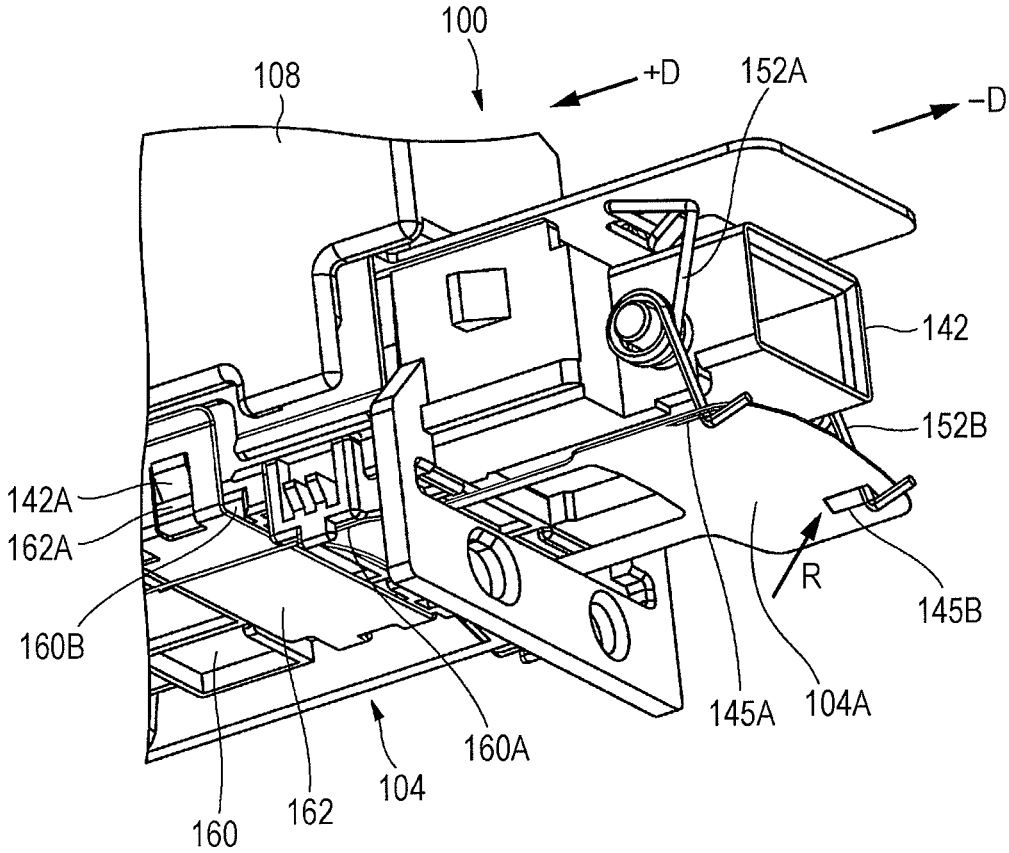
FIG. 8 illustrates one end portion of the charging unit according to the exemplary embodiment of the present invention.

As illustrated in FIG. 8, the attachment member 142 is provided with spring members 152A and 152B (examples of a first pressing member) that urge the grid electrode 104 in the direction of arrow −D. The spring members 152A and 152B may be, for example, torsion springs, and are fixed to the attachment member 142 at one end thereof and hooked to the edges of the attachment holes 145A and 145B at the other end thereof, the attachment holes 145A and 145B being formed in the grid electrode 104 at the first end thereof in the longitudinal direction.

Figure 9:
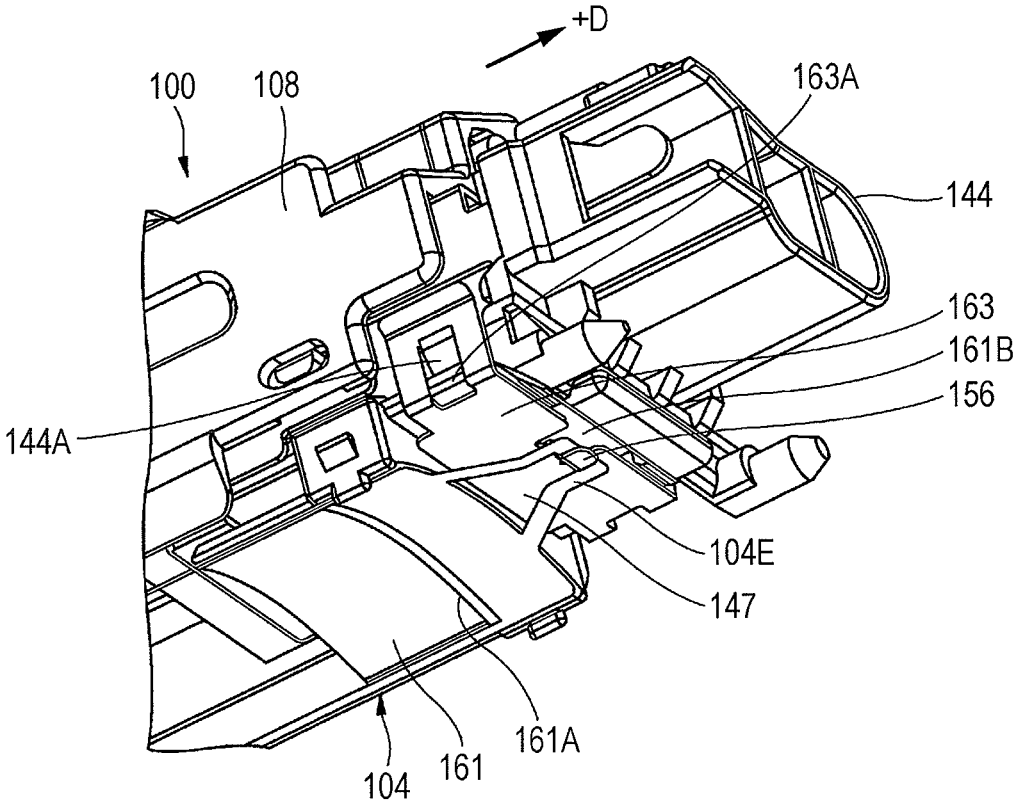
FIG. 9 illustrates the other end portion of the charging unit according to the exemplary embodiment of the present invention.

As illustrated in FIG. 9, a hook portion 156 (an example of a second pressing member) used to secure the second end of the grid electrode 104 in the longitudinal direction is provided at the bottom of the attachment member 144. The hook portion 156 is bent in the direction of arrow +D, and is hooked to an end of the attachment hole 147 formed in the grid electrode 104.

Referring to FIGS. 8 and 9, the grid electrode 104 is attached to the charging unit 100 by pulling the grid electrode 104 in the direction of arrow +D while the spring members 152A and 152B are respectively hooked to the attachment holes 145A and 145B in the grid electrode 104, and hooking the hook portion 156 to the attachment hole 147.

As illustrated in FIGS. 8 and 9, support members 160 and 161 are respectively attached to the attachment members 142 and 144, which are attached to the charging unit 100. The support members 160 and 161 respectively include support surfaces 160A and 161A on which the grid electrode 104 is supported, and cover the inside of the attachment members 142 and 144. The support surfaces 160A and 161A are concave surfaces that face downward, and support both ends of the grid electrode 104 in the longitudinal direction at the side at which the charge wires 102A and 102B are provided. Thus, the grid electrode 104 is curved along the support surfaces 160A and 161A so as to be concentric with the photoconductor 62.

The support members 160 and 161 are respectively fixed to the attachment members 142 and 144 by fixing members 162 and 163. The fixing members 162 and 163 respectively extend over the support members 160 and 161 in the width direction and have fitting holes 162A and 163A in which locking pawls 142A and 144A formed on the attachment members 142 and 144 are fitted. Accordingly, force that presses the support members 160 and 161 against the attachment members 142 and 144, respectively, is generated by the fixing members 162 and 163, and the support members 160 and 161 are assembled to the attachment members 142 and 144, respectively, without leaving gaps therebetween.

The support members 160 and 161 have a stepped shape and include fixing surfaces 160B and 161B formed at positions closer to the attachment members 142 and 144 than the support surfaces 160A and 161A. In other words, the fixing surfaces 160B and 161B are recessed upward from the support surfaces 160A and 161A when viewed from below. The support members 160 and 161 are fixed to the attachment members 142 and 144 by the fixing members 162 and 163, respectively, at the fixing surfaces 160B and 161B thereof, so that the grid electrode 104 does not interfere with the fixing members 162 and 163. The above-described hook portion 156 is formed on the fixing member 163 so as to project downward, and is hooked to the end of the attachment hole 147 in the grid electrode 104 at the same position as the support surface 161A or at a position closer to the attachment member 144 than the support surface 161A.

The spring members 152A and 152B, which are examples of a first pressing member, are torsion springs for applying tension to the grid electrode 104. The spring members 152A and 152B are hooked to the first end of the grid electrode 104 in the longitudinal direction. Accordingly, the direction in which the torsion of the spring members 152A and 152B is applied (direction shown by R in FIG. 8) corresponds to the direction in which the support member 160 is pressed against the attachment member 142 by the grid electrode 104. As a result, the first end of the curved grid electrode 104 in the longitudinal direction is pressed against the support surface 160A of the support member 160, and the support member 160 is in tight contact with the attachment member 142.

In addition, the hook portion 156, which is an example of a second pressing member, is formed on the fixing member 163 and is hooked to the end of the attachment hole 147 in the grid electrode 104 at the same position as the support surface 161A or at a position closer to the attachment member 144 than the support surface 161A, as described above. Accordingly, the second end of the curved grid electrode 104 in the longitudinal direction is pressed against the support surface 161A of the support member 161. Since the fixing member 163 (or the hook portion 156 formed thereon) is hooked to the first end of the grid electrode 104, the tension applied to the grid electrode 104 is used as the force for pressing the support member 161 against the attachment member 144.

The operation of the present exemplary embodiment will now be described.

Figure 10:
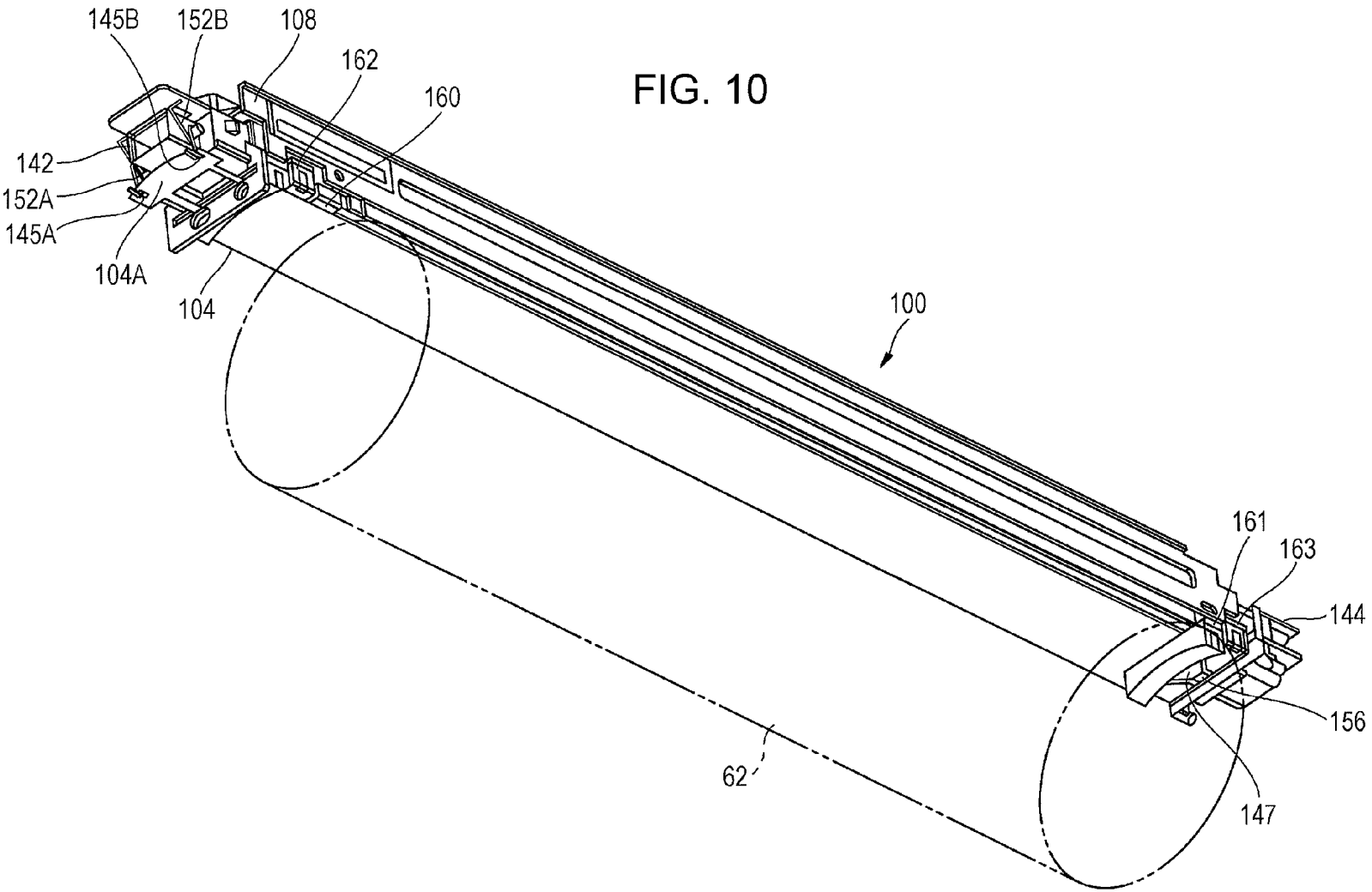
FIG. 10 is a perspective view illustrating the relationship between the charging unit and a photoconductor according to the exemplary embodiment of the present invention.

In a printing operation, as illustrated in FIGS. 5A and 5B, the motor 132 is driven by the controller 20 (see FIG. 1) so that the slide members 126 and 128 are moved in the direction of arrow −D and the guide rails 109 and 111 are moved downward. Accordingly, as illustrated in FIG. 10, the charging unit 100 is moved to a position where the charging unit 100 may charge the outer peripheral surface of the photoconductor 62.

Here, the grid electrode 104 of the charging unit 100 is curved so as to be concentric with the photoconductor 62 by using the support members 160 and 161 attached to the shielding member 105. In this structure, when there are gaps between the shielding member 105 and the support members 160 and 161, the distance between the grid electrode 104 and the photoconductor 62 cannot be made uniform.

According to the present exemplary embodiment, the support members 160 and 161 are respectively fixed to the attachment members 142 and 144 by the fixing members 162 and 163, and are therefore in tight contact with the attachment members 142 and 144 without leaving gaps therebetween. In addition, owing to the spring members 152A and 152B, which are torsion springs, and the hook portion 156 formed on the fixing member 163, the grid electrode 104 is pressed against the curved support surfaces 160A and 161A on the support members 160 and 161 and is supported at the side at which the charge wires 102A and 102B are provided.

Accordingly, the grid electrode 104 having the curved shape is attached to the charging unit 100 with high accuracy while the curved shape thereof is maintained by the support surfaces 160A and 161A, and is accurately positioned so that the grid electrode 104 is separated from the photoconductor 62 by the distance d.

In addition, since the grid electrode 104 is pressed against the curved support surfaces 160A and 161A on the support members 160 and 161 by the spring members 152A and 152B and the hook portion 156, the grid electrode 104 may be pressed against the support surfaces 160A and 161A with a simple structure.

Referring to FIGS. 5A and 5B, when the charging unit 100 is attached to or detached from the image forming unit (see FIG. 1) in the image forming apparatus 10, the motor 132 is driven in the reverse direction by the controller 20 (see FIG. 1) so that the slide members 126 and 128 are moved in the direction of arrow +D and the guide rails 109 and 111 are moved in the direction of arrows UP. Accordingly, the charging unit 100 is moved from the position where the charging unit 100 may charge the outer peripheral surface of the photoconductor 62 to the position that is further away from the photoconductor 62 than the position where the charging unit 100 may charge the outer peripheral surface of the photoconductor 62.

Then, the charging unit 100 may be detached from the image forming unit 14 by removing the guide rails 109 and 111 from the slide members 126 and 128.

The support surfaces 160A and 161A are not limited to those having a continuously curved shape, and may instead include projections that form a curved shape as a whole.

In the image forming apparatus according to the exemplary embodiment of the present invention, the recording method may be arbitrarily selected. The present invention is applicable to various types of image forming apparatuses, such as a tandem-type image forming apparatus, that record images by using toner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment wax chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a discharge electrode that is attached to a base member and that is configured to discharge electricity to supply an electric charge to a latent-image carrier that is configured to carry an electrostatic latent image;

a control electrode that is located on the latent-image-carrier side of the discharge electrode attached to the base member, that is curved along the latent-image carrier, and that is configured to control a potential of the latent-image carrier;

a support member that is fixed to the base member by a fixing member and comprises a curved support surface that supports both ends of the control electrode in a longitudinal direction at a side at which the discharge electrode is provided; and first and second pressing members that are provided at respective ends of the control electrode in the longitudinal direction and that re configured to pull the control electrode in the longitudinal direction thereby the control electrode pressing against the support surface, wherein the fixing member extends over the support member in a widthwise direction perpendicular to the longitudinal direction and is configured to press the support member against the base member.

2. The charging device according to claim 1, wherein the first pressing member comprises a torsion spring that is configured to be hooked to one end of the control electrode in the longitudinal direction to press the control electrode against the support surface by torsion, wherein the fixing member comprises a fixing surface at which the support member is fixed, the fixing surface being closer to the base member than the support surface, and wherein the second pressing member comprises a hook portion that is provided on the fixing member and configured to be hooked to the other end of the control electrode in the longitudinal direction to press the control electrode against the support surface.

3. An image forming apparatus comprising:

the charging device according to claim 1;

the latent-image carrier that is charged by the charging device and configured to carry a latent image formed by irradiation with light;

a developing unit configured to develop the latent image with developer to form a developer image; and a transfer unit configured to transfer the developer image onto a recording medium.

4. An image forming apparatus comprising:

the charging device according to claim 2;

the latent-image carrier that is charged by the charging device and configured to carry a latent image formed by irradiation with light;

a developing unit configured to develop the latent image with developer to form a developer image; and a transfer unit configured to transfer the developer image onto a recording medium.

* * * * *